US007574840B1

(12) United States Patent
Fyfe

(10) Patent No.: US 7,574,840 B1
(45) Date of Patent: Aug. 18, 2009

(54) CONNECTOR FOR REINFORCING THE ATTACHMENT AMONG STRUCTURAL COMPONENTS

(75) Inventor: Edward R. Fyfe, Del Mar, CA (US)

(73) Assignee: Fyfe Co., LLC, San Diego, CA (US)

( * ) Notice: Subject to any disclaimer, the term of this patent is extended or adjusted under 35 U.S.C. 154(b) by 695 days.

(21) Appl. No.: 11/399,282

(22) Filed: Apr. 6, 2006

Related U.S. Application Data

(63) Continuation-in-part of application No. 10/205,294, filed on Jul. 24, 2002, now Pat. No. 7,207,149.

(51) Int. Cl.
*E04B 1/38* (2006.01)

(52) U.S. Cl. ..... 52/582.1; 52/223.13; 52/586.2; 52/585.1; 52/223.14; 52/712; 52/747.1; 52/741.1

(58) Field of Classification Search ..... 52/223.13, 52/223.14, 582.1–585.1, 707, 698, 700, 703, 52/706, 708, 712, 261, 271, 272, 286, 256, 52/606–607, 223.4, 596, 600; 403/169–170, 403/172
See application file for complete search history.

(56) References Cited

U.S. PATENT DOCUMENTS 513,794 A * 1/1894 Lee ..... 52/223.14
2,737,802 A * 3/1956 Bakker ..... 52/223.13
3,086,273 A * 4/1963 Welborn ..... 264/228
3,247,635 A * 4/1966 Burns ..... 52/223.13
3,464,173 A * 9/1969 Ros ..... 254/29 A
3,513,609 A * 5/1970 Lang ..... 52/223.6
3,738,071 A * 6/1973 Finsterwalder ..... 52/155
5,657,595 A * 8/1997 Fyfe et al. ..... 52/252
5,675,943 A * 10/1997 Southworth ..... 52/167.1
6,216,403 B1 * 4/2001 Belbeoc'h ..... 52/223.13
6,327,825 B1 * 12/2001 Sanders et al. ..... 52/167.1
6,345,473 B1 * 2/2002 Fink et al. ..... 52/167.1
6,524,980 B1 * 2/2003 Fensel et al. ..... 442/181
6,571,518 B1 * 6/2003 Barley ..... 52/223.13
6,647,678 B1 * 11/2003 Zambelli et al. ..... 52/252

* cited by examiner

*Primary Examiner*—Jeanette Chapman
(74) *Attorney, Agent, or Firm*—Palomar Patent; Mary Jo Redman; Calif Tervo

(57) ABSTRACT

Reinforcing connector (10) for reinforcing attachment among components (110) of a structure (100); such as crossing beams (111), beam (111) supporting a slab deck (113), or masonry blocks (118). Reinforcing connector (10) includes a length of roving (20) composed of filaments (25). Roving (20) is disposed in borehole (50) piercing component (110). Free ends (21,23) of roving (20) protrude from borehole openings (51) and are splayed apart into individual filaments (25). Filaments (25) are attached to surfaces of components (110) with adhesive means (30). Reinforcing connector (10) increases ductility and resistance to lateral forces of structure (100).

11 Claims, 2 Drawing Sheets

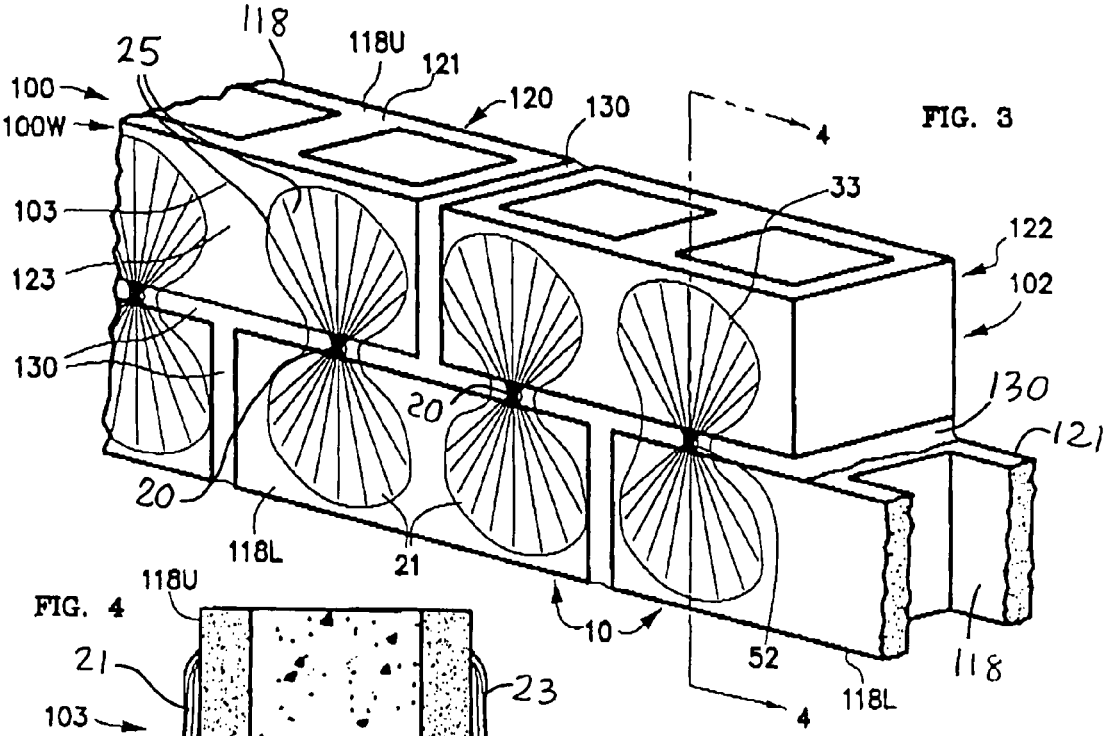
FIG. 3
FIG. 4
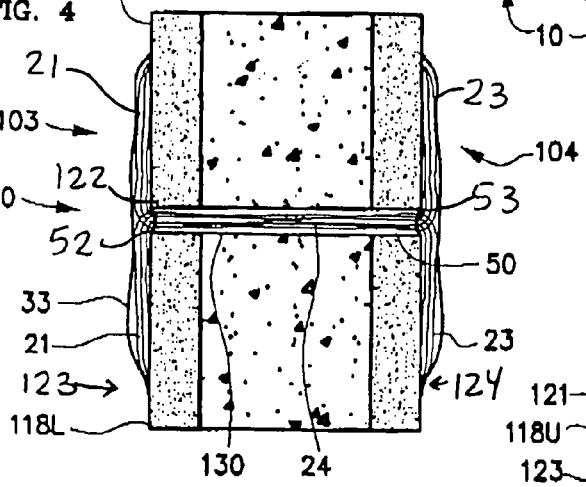
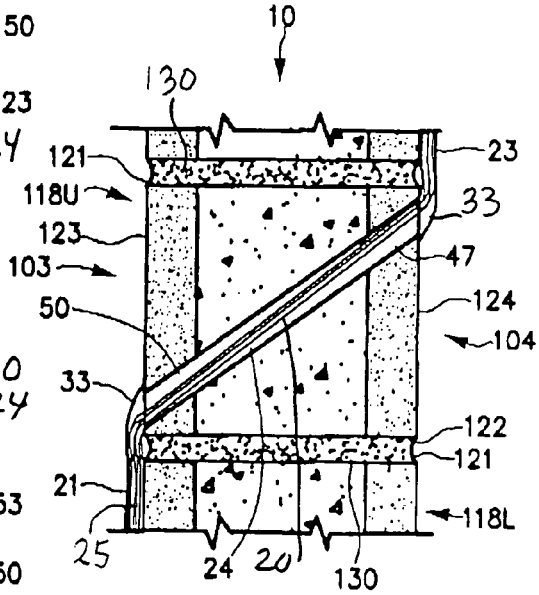
FIG. 5
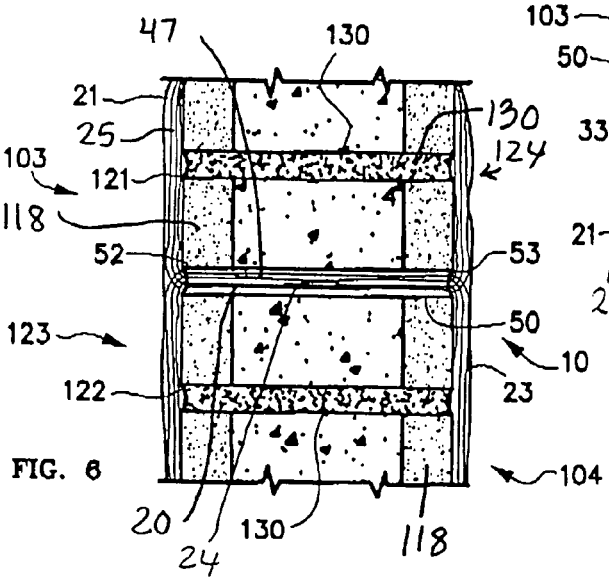
FIG. 6

CONNECTOR FOR REINFORCING THE ATTACHMENT AMONG STRUCTURAL COMPONENTS

CROSS-REFERENCE TO RELATED APPLICATIONS

This application is a Continuation-in-Part of application Ser. No. 10/205,294, filed Jul. 24, 2002 now U.S. Pat. No. 7,207,149.

FIELD OF THE INVENTION

This invention relates in general to reinforcing a structure, and more particularly to a connector for reinforcing the attachment among the components of a structure.

BACKGROUND OF THE INVENTION

Buildings have traditionally been designed to support their own weight plus that of expected inhabitants and furnishings. Buildings and other structures for supporting weight have long been expected to be very strong under vertical compression. Concrete is a favorite material for weight-bearing structures because it is inexpensive and has exceptional compressive strength.

In the mid-1900s, architects began to take lateral forces into account more than they had previously. Wind can exert strong lateral force on tall buildings and long bridges. Smaller structures were still designed without much regard for strong lateral forces until concern for earthquake resistance began growing in the 1970s in the United States, partly due to the massive Anchorage earthquake in 1964.

Many buildings are still in use that were not built to withstand strong lateral forces. Some smaller structures, such as masonry block walls have almost no built-in resistance to lateral forces. These could be toppled or collapsed by an earthquake and kill or injure people.

There is a need for a means to reinforce old structures so that they resist strong lateral force, such as could be caused by earthquake, storm, or explosion. Some present techniques for reinforcing structures require encapsulation of the structure in steel rods or panels, sprayed-on concrete, or resin-impregnated fiber panels. Other techniques require extensive excavation next to the structure or addition of external buttresses. These present techniques have disadvantages and are not applicable to all situations.

New structures are often built of multiple prefabricated components, such as concrete beams, columns, or masonry blocks; combinations of prefabricated and poured-in-place components are also used. In the past, gravity and friction were frequently the main means of passive connection of components. For example, a structure consisting of a slab deck atop prefabricated columns will stay in position indefinitely, as long as the structure is only supporting its own weight and the weight of the people, vehicles, or other components that are on the slab.

To withstand lateral forces such as seismic or wind forces, however, a structure's components must be strongly connected together. Yet, it has been found that extremely rigid structures do not fare as well in earthquakes or wind as structures with some flexibility.

The connector of the present invention is an inexpensive and effective way to reinforce many types of structure. The present invention can be installed in a small area with minimal disruption of the functioning of an existing and occupied structure. The connector is also useful and cost-effective for reinforcing new structures.

The invention is an efficient way to reinforce masonry block walls and large structures that include slabs columns, and beams.

SUMMARY OF THE INVENTION

The present invention is a connector that reinforces the attachment between multiple structural components. A structure reinforced by connectors of the invention is less likely to fail under lateral forces, such as those experienced during an earthquake, hurricane, or explosion.

The connector includes a length of roving made of high-tensile-strength flexible filaments. Typically, the roving is connected to a first structural component by threading the roving through a borehole drilled through the component and backfilling the borehole with epoxy, polyurethane, or grout.

The two free ends of the roving extend out from the opposite ends of the borehole. Each end then has its individual filaments splayed apart and the filaments are attached to a surface of a second structural component with adhesive. Splaying apart the filaments spreads the force applied by the connector over a large surface area to prevent the connector from popping out a chunk of the second component when a force is experienced. Also, attaching the filaments over a large area typically increases the strength of the adhesive bond.

Using this connector, large prefabricated components can be "tied" together so as to resist forces from any direction. The connector increases the apparent ductility of the structure such that failure, if it occurs, is gradual instead of sudden and catastrophic.

The invention will now be described in more particular detail with respect to the accompanying drawings, in which like reference numerals refer to like parts throughout.

BRIEF DESCRIPTION OF THE DRAWINGS

FIG. 3 is a perspective view, partly cut away, of an alternative embodiment of the connector of the invention reinforcing the connection among multiple masonry blocks in a wall.

FIG. 4 is a sectional view taken on line 4-4 of FIG. 3.

FIGS. 5 and 6 are sectional views analogous to FIG. 4 and showing alternative embodiments of the connector of FIG. 3.

DETAILED DESCRIPTION OF THE INVENTION

Figure 1:
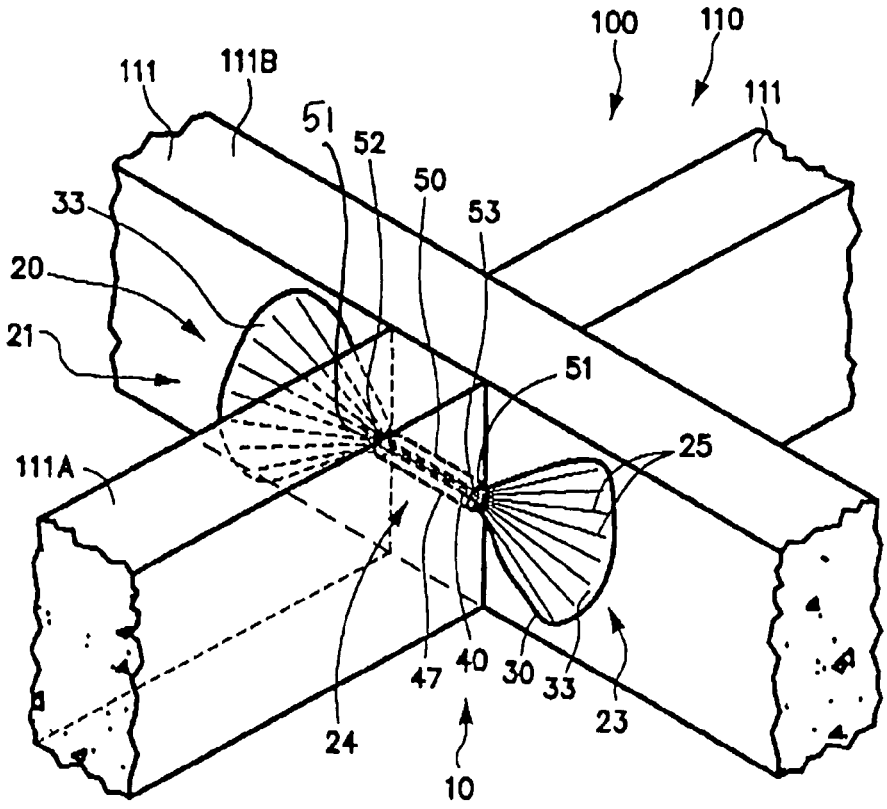
FIG. 1 is a perspective view, partly cut away, of the connector of the present invention reinforcing the connection of two perpendicular beams.

FIG. 1 is a perspective view, partly cut away, of the connector 10 of the present invention reinforcing the connection of two components 110, such as perpendicular beams 111, such as of a structure 100.

Connector 10 generally includes roving 20, borehole 50 piercing first beam 111A, backfill 40, and adhesive means 30.

Roving 20 is inserted into borehole 50 with free ends 21,23 protruding from borehole borehole openings 51. Middle portion 24 of roving 20 is disposed in borehole 50 between first borehole borehole opening 52 and second borehole borehole opening 53. Backfill 40, such as epoxy resin 47, is added to borehole 50 to anchor roving 20 within borehole 50. Epoxy resin 47 fills borehole 50, embedding roving 20, and adheres to the inner surface of borehole 50. The two free ends 23 are splayed so that filaments 25 are substantially separate. Filaments 25 are attached to outer surfaces of second beam 111B, by adhesive means 30.

Borehole 50 is typically created by drilling, but other methods such as high-pressure water boring may also be used. The terms "drill" or "drilling" as used in this specification or in the claims should be read as including other methods of providing a borehole.

Borehole 50 is a hole or groove that allows passage of the length of roving from one surface of a structural component 110 to another surface, generally an opposite one. Borehole 50 may be completely surrounded by a single structural component 110 or borehole 50 may be mostly within a first component 110 but bordered by a second component 110. Alternatively, borehole 50 may be partially surrounded by a first component 110 and partially surrounded by a second component 110. Alternatively, borehole 50 may be a groove in a surface of a component 110, which is approximately as deep as the nominal diameter of roving 20 and is capable of retaining roving 20 and backfill material 40 until backfill material 40 is hardened enough to retain roving 20 against removal.

Roving 20 is typically a loosely twisted length of flexible filaments 25. Filaments 25 are generally the same length as roving 20; that is, roving 20 is not composed of short, fuzzy filaments that hold together by friction. Filaments 25 may be made of glass, graphite, nylon, aramid, carbon, high-modulus polyethylene, ceramic, quartz, PBO, fullerene, LCP, steel, or other material that can be manufactured in long filaments and that has high tensile strength.

Backfill 40 is preferably a solidifiable fluid that can be poured or injected into borehole 50 and that preferably hardens without addition of heat or evolution of toxic or obnoxious fumes. Backfill 40 can be a cementitious material, such as grout or a synthetic or natural curable resin, such as epoxy 47, polyurethane, acrylic, or other resin that has good cohesive and adhesive strength. The viscosity of backfill 40, when in the fluid state, is preferably low enough that backfill 40 flows around roving 20 to embed it intimately. Roving 20 may include an adhesion promoting coating on the surface of filaments 25 to increase the adhesion between roving 21 and backfill 40.

Filaments 25 of each free end 21, 23 are spread apart, such as by pulling and using the hands to apply shearing force generally perpendicular to the length of roving 20. The separated filaments 25 are splayed against an area of the surface of second beam 111B that is adjacent a borehole opening 51. The area of the surface of second beam 111B against which filaments 25 are splayed is typically at least three times as wide as the nominal diameter of roving 20; thus, the length of free ends 21, 23 protruding from a borehole opening 51 must be at least equal to the nominal diameter of roving 20 and is generally greater. By "nominal diameter" is meant the average diameter of roving 20, when roving 20 is neither compressed nor with filaments 25 splayed apart.

The splayed filaments 25 are attached to an area of the surface of second beam 111B by adhesive means 30, such as epoxy resin 33. Adhesive means 30 may be any of many synthetic or natural resins, such as polyurethane, polyurea, acrylic, latex, or silicone, that have high cohesive and adhesive strength and that adhere well to roving 20 and the surface of second beam 111B. Adhesive means 30 may also include an inorganic material, such as cementitious grout, or a composite, such as a panel of resin-impregnated fiberglass.

After backfill 40 and adhesive means 30 are hardened, motion of first beam 111A relative to second beam 111B will put tensile force on roving 20, which opposes and limits the motion. More than one connector 10 can be attached to a structure, if needed, to prevent movement in different directions. However, because filaments 25 are splayed over a relatively wide area of the surface of second beam 111B, connector 10 opposes a range of force vectors. This is an advantage of connector 10 over reinforcement methods with a single-point attachment, such as a cable or strap.

In a further advantage, the tensile force on adhesive means 30 is spread over a wide area, reducing the chance of failure. Reinforcement by a cable or strap may cause a cohesive failure within a component 110 such that a chunk of the component 110 could be pulled out by the cable or strap during an earthquake or other lateral force event.

Figure 2:
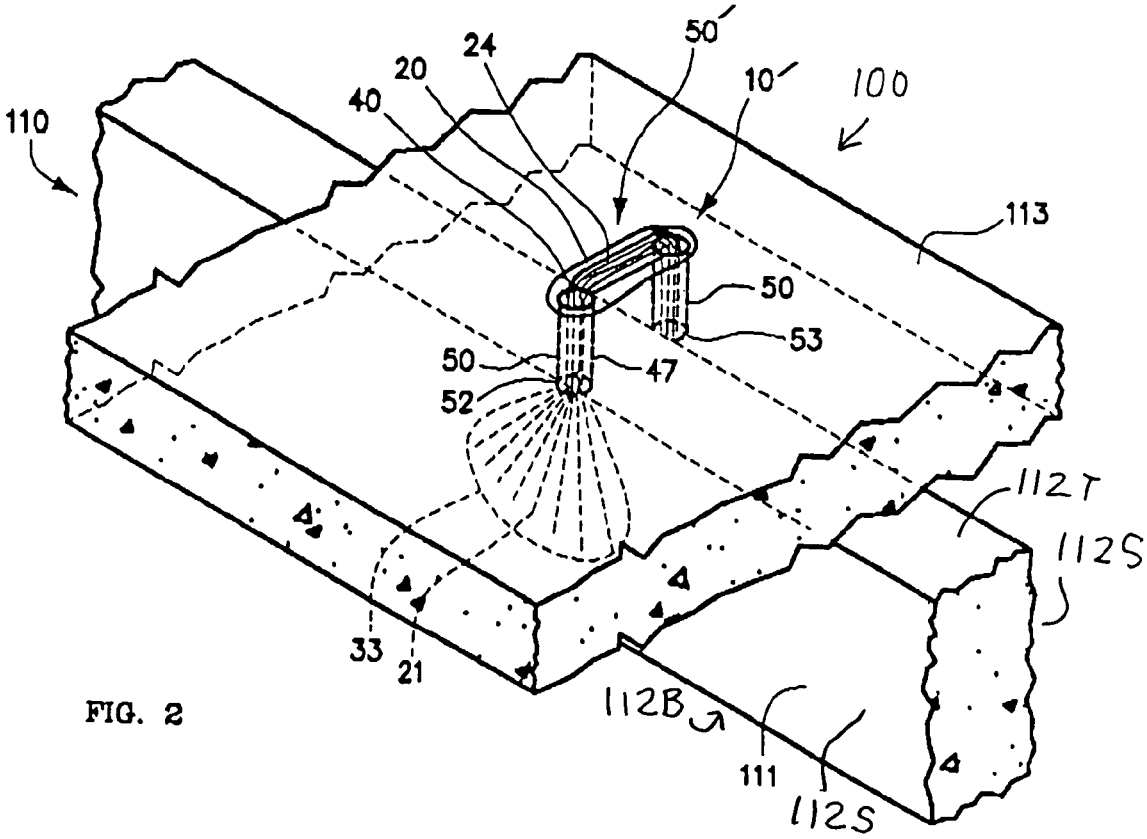
FIG. 2 is a perspective view, partly cut away, of an alternative embodiment of the connector of the invention reinforcing the connection between a slab deck and an underlying beam.

FIG. 2 is a perspective view, partly cut away, of an alternative preferred embodiment of connector 10' reinforcing the connection between two components 110 of a structure 100, including a generally planar component such as a slab deck 113 and a generally linear supporting component such as beam 111 having a longitudinal axis X.

Slab deck includes a top surface 114T, a bottom surface 114B, and paired boreholes 50 piercing slab deck 113 from top surface 114T to 114B. Paired boreholes 50 are disposed on either side of beam 111; that is, paired boreholes 50 are symmetrical about the longitudinal axis of beam 111 and are spaced apart by a distance slightly greater than the horizontal width of beam 111. Beam 111 includes a top 112T, a bottom 112B, and two sides 112S.

Each of paired boreholes 50 includes a first opening 52 connecting with top surface 114T of slab deck 113 and a second opening 53 connecting with bottom surface 114B of slab deck 113. Top surface 114T includes a middle portion 115 between the pair of first openings 52 of the pair of boreholes 50.

Middle portion 24 of roving 20 is looped through boreholes 50 and around middle portion 115 of slab deck 113; thus, paired boreholes 50 and the portion of slab deck 113 between them cooperate to create what may be considered a longer single borehole 50' that includes two right angle bends, and a pair of openings 53 connecting with bottom surface 114B and disposed adjacent opposite sides 112S of beam 111.

Optionally, middle portion 115 of slab deck 113 includes a groove (not shown) between paired first borehole openings 52. The optional groove is approximately as deep as the nominal diameter of roving 20 in slab deck 113 and is for helping to protect roving middle portion 24 from abrasion and provides a channel to maintain backfill material 40 such as epoxy 47 in close contact with roving middle portion 24 during curing of epoxy 47.

Both free ends 21,23 (not seen) protrude from a borehole opening 53. Both free ends 21,23 are splayed and filaments 25 are attached to surfaces of beam 111, such as sides 112S, with adhesive means 30 such as epoxy resin 33. As can be seen from FIG. 2, connector 10' opposes separation of slab deck 113 from beam 111 in a vertical direction and also opposes lateral movement of slab deck 113 relative to beam 111.

An alternative embodiment of connector 10' loops roving middle portion 24 below bottom 112B of beam 111, with free ends 21,23 protruding upwardly from paired openings 52. In this alternative embodiment, free ends 21, 23 are splayed apart and attached to top surface 114T of slab deck 113 with epoxy 33. This alternative embodiment of connector 10' would be as strong as the connector 10' shown in FIG. 2, but might be less convenient to install in most circumstances.

Epoxy backfill resin 47 and epoxy adhesive 33 are synthetic resins that adhere well to many construction materials and have good cohesive strength. Other synthetic and natural resins with these qualities may also be used, including but not limited to polyurethane, acrylic, and silicone. Inert filler material may be included in epoxy backfill resin 47 or epoxy adhesive 33, or both, in order to make the thermal expansion characteristics of backfill resin 47 and epoxy adhesive 33 more similar to those of components 110.

It is preferred that adhesive means 30, roving 20, and backfill material 40 be water resistant and able to retain their strength over long periods of time, even when exposed to thermal cycling, including that due to seasonal and diurnal variation. It is preferred, in some cases, that adhesive means 30, roving 20, and backfill material 40 include additive or coating, not shown, to render the materials more resistant to ultraviolet radiation and fire.

Although roving 20 is preferably composed of high strength filaments 25, it is foreseen that roving 20 may break under great stress. It is generally preferred that connector 10 should fail in a ductile, gradual manner, rather than in a brittle, sudden manner. For this reason, roving 20 may be composed of more than one type of filament 24. For example, glass filaments 25 may be intermixed with graphite filaments 25; or graphite filaments of different diameters may be mixed within roving 20. The filaments 25 with lower ductility will break first, then the filaments 25 with greater ductility will stretch, and finally the stretched filaments 25 of greater ductility will snap. This preferred behavior is known as ductile performance.

When a structure breaks in a gradual, ductile manner, it may be possible to notice that failure is impending and do corrective repairs. Even if failure is rapid enough that repair is not possible, there may be sufficient time to at least evacuate the structure safely.

If all filaments 25 were of equal strength and ductility, the breakage of a few filaments 25 could cascade rapidly into sudden breakage of all filaments 25, possibly followed by catastrophic collapse of the structure. This non-preferred behavior is known as brittle performance.

FIGS. 3-6 depict connector 10 used to reinforce a structure 100, such as wall 100W, built of masonry blocks 118. FIG. 3 is a perspective view of a wall 100 built of multiple blocks 118. Blocks 118 are shown attached together by mortar 130 placed between blocks 118, as is typical but not necessary. A plurality of connectors 10 reinforce the connection between upper blocks 118U and lower blocks 118L.

Mortar 130 attaches blocks 118U to blocks 118L strongly enough for wall 100 to support its own weight and the weight of other structures placed on it against the downward force of gravity. The plurality of connectors 10 reinforces the connection among blocks 118 so that wall 100 will maintain its integrity even against strong lateral forces. Because mortar 130 is relatively brittle, masonry walls 100 without connectors 10 often fall apart suddenly into individual blocks 118 when stressed by a moderate to large earthquake. The ductility and tensile strength of connectors 10 allow wall 100 to bend and flex without crumbling into individual blocks 118. Should an earthquake or other force be large enough to cause a wall 100 that is reinforced with a plurality of connectors 10 to fail, the failure is likely to be gradual, allowing time for occupants to evacuate.

Each block 118 includes a body 120, which includes a top 121, a bottom 122, an outer face 123, and an inner face 124. The outer faces 123 of blocks 118 define the outer face 103 of wall 100W. The inner faces 124 of blocks 118 define the inner face 104 of wall 100W.

In general, a borehole 50 is drilled through wall 100W from outer face 103 to inner face 104. Roving 20 is pushed through borehole 50 such that middle portion 24 is disposed within borehole 50, first free end 21 protrudes from first borehole opening 52, and second free end 23 protrudes from second borehole opening 53. Borehole 50 is backfilled with backfill epoxy resin 47 such that middle portion 24 is embedded and prevented from being removed from borehole 50. Free ends 21, 23 are splayed apart and filaments 25 are attached to outer face 103 and inner face 104 by adhesive epoxy resin 33. Preferably, free ends 21, 23 are attached to outer and inner faces 103,104 such that multiple blocks 118 are connected together by connector 10.

FIG. 4 is a sectional view taken on line 4-4 of FIG. 3. Borehole 50 has been drilled through mortar 130 that is between bottom 122 of upper block 118U and top 121 of lower block 118L. Filaments 25 of first free end 21 are splayed apart and attached to the outer faces 123 of both upper block 118U and lower block 118L. Filaments 25 of second free end 23 are splayed apart and attached to inner faces 124 of both blocks 118U and 118L. An advantage of this configuration of connector 10 is that drilling borehole 50 through mortar 130 is relatively easy.

FIG. 5 shows an alternative method of practicing the invention. Borehole 50 is drilled at an angle through a block 118 from block outer face 123 to block inner face 124. First free end 21 is attached to outer faces 123 both of the drilled block 118U and the block below, 118L. Second free end 23 is analogously attached to the inner faces 124 of drilled block 118U and another block 118 above drilled block 118U. An advantage of this configuration of connector 10 is that three blocks 118 are reinforced by a single connector 10.

FIG. 6 shows a borehole 50 drilled through the vertical center of a block 118 from outer face 123 to inner face 124. A long length of roving 20 has been inserted into borehole 50 and backfilled. Free ends 21,23 are splayed such that filaments 25 of each free end 21,23 are attached to and connect the drilled block 118 to the blocks 118 above and below drilled block 118.

Although particular embodiments of the invention have been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. In combination:

a structure including:

a first, generally planar component; including:

a top surface;

a bottom surface; and a second, generally linear component supporting said first component; including:

a top disposed beneath said bottom surface of said first, planar component, a bottom, and a pair of sides; and a reinforcing connector for reinforcing the attachment between said first and said second components of said structure; including:

a pair of boreholes piercing said first component from said top surface to said bottom surface; one said borehole disposed on either side of said second component; each said borehole including:

a first borehole opening connecting with said top surface of said first planar component; and a second borehole opening connecting with said bottom surface of said first planar component;

a length of roving, including:

two free ends; each said free end protruding from opposite said borehole openings, and a middle portion between said two free ends; said middle portion disposed through said boreholes and looped around a portion of one said component of said structure;

backfill material filling said boreholes and surrounding said middle portion of said roving such that said middle portion is anchored against removal from said boreholes; and adhesive attaching said free ends to a different said component other than said component said middle portion of said roving is looped around.

2. The combination of claim 1, said first planar component further including:

a middle portion between said pair of boreholes; and wherein: said middle portion of said roving is disposed through said pair of boreholes and looped around said middle portion of said first planar component; and wherein: said free ends protrude from opposite second borehole openings; and wherein: each said free end is attached to an adjacent side of second linear component by adhesive means.

3. The combination of claim 1, wherein: said middle portion of said roving is disposed through said pair of boreholes and looped around said bottom of said second linear component; and wherein: said free ends protrude from opposite first borehole openings; and wherein: each said free end is attached to said top surface of said first planar component by adhesive means.

4. The combination of claim 1, wherein said roving comprises:

a bundle of filaments; including:

filaments of a first material having a first ductility; and filaments of a second material having a second ductility different from said first ductility; such that said length of roving would break gradually if stressed beyond its strength.

5. The combination of claim 1, wherein said roving comprises:

a bundle of filaments; including filaments of at least one of the materials of the group: steel, glass, graphite, nylon, aramid, carbon, high-modulus polyethylene, ceramic, quartz, PBO, fullerene, or LCP.

6. In combination:

a masonry wall including:

an inner face; and an outer face; and a plurality of masonry blocks arrayed so as to form said wall; including:

a first block; and a second block; each said masonry block including:

a top;

a bottom;

two opposing ends; and an outer face, facing outwardly and comprising part of said outer face of said wall; and an inner face, facing opposite to said outer face and comprising part of said inner face of said wall; and a borehole piercing said wall from said outer face to said inner face; said borehole including:

a pair of openings at opposite ends of said borehole; including:

an outer borehole opening; and an inner borehole opening; and a reinforcing connector for reinforcing the attachment among said plurality of masonry blocks; including:

a length of roving; including:

two free ends; and a middle portion between said two free ends; said middle portion disposed in said borehole and said free ends each protruding from an opposite said borehole opening of said borehole;

backfill material filling said borehole and surrounding said roving such that said roving is anchored against removal from said borehole; and adhesive attaching said free ends to said outer and said inner faces of said wall so as to reinforce the attachment between said first and said second blocks.

7. The combination of claim 6, wherein said borehole passes through said first block from said outer face to said inner face; and wherein at least one said free end is attached to said second block.

8. The combination of claim 7, wherein said first block is arrayed below said second block and above a third said block; and wherein: one said free end is attached to one said face of said third block.

9. The combination of claim 6, said wall including:

mortar between said plurality of blocks for attaching said blocks together; and wherein said borehole is substantially within said mortar between said top of a first said block and said bottom of a second said block; and wherein said free ends include:

a first free end attached to said outer faces of said first and second said blocks; and a second free end attached to said inner faces of said first and second said blocks.

10. The combination of claim 6, wherein said roving comprises:

a bundle of filaments; including:

filaments of a first material having a first ductility; and filaments of a second material having a second ductility different from said first ductility; such that said length of roving would break gradually if stressed beyond its strength.

11. The combination of claim 6, wherein said roving comprises:

a bundle of filaments; including filaments of at least one of the materials of the group: steel, glass, graphite, nylon, aramid, carbon, high-modulus polyethylene, ceramic, quartz, PBO, fullerene, or LCP.

* * * * *